US008360515B2

(12) United States Patent
Crum

(10) Patent No.: US 8,360,515 B2
(45) Date of Patent: Jan. 29, 2013

(54) RECLINER OTTOMAN LINKAGE WITH UNIQUE SECONDARY OTTOMAN

(75) Inventor: Michael Andrew Crum, Mantachie, MS (US)

(73) Assignee: L & P Property Management Company, South Gate, CA (US)

( * ) Notice: Subject to any disclaimer, the term of this patent is extended or adjusted under 35 U.S.C. 154(b) by 332 days.

(21) Appl. No.: 12/776,872

(22) Filed: May 10, 2010

(65) Prior Publication Data

US 2010/0283297 A1 Nov. 11, 2010

Related U.S. Application Data

(60) Provisional application No. 61/177,135, filed on May 11, 2009.

(51) Int. Cl.
*A47C 1/031* (2006.01)

(52) U.S. Cl. ..... 297/85 R

(58) Field of Classification Search ..... 297/85 R, 297/84

See application file for complete search history.

(56) References Cited

U.S. PATENT DOCUMENTS 3,244,449 A * 4/1966 Re ..... 297/75
3,400,975 A * 9/1968 Rogers, Jr. ..... 297/75
3,550,952 A 12/1970 Ferguson
5,169,208 A * 12/1992 Re et al. ..... 297/85 L
5,388,886 A * 2/1995 LaPointe et al. ..... 297/75
5,419,611 A * 5/1995 Cook ..... 297/85 L
6,142,558 A 11/2000 May
6,769,734 B2 * 8/2004 Tacker ..... 297/61
6,793,279 B2 * 9/2004 Hoffman et al. ..... 297/84
7,762,625 B2 * 7/2010 Hoffman et al. ..... 297/85 L
2009/0174251 A1 * 7/2009 Lawson et al. ..... 297/85 R

OTHER PUBLICATIONS

International Search Report and Written Opinion of the International Searching Authority in International Application No. PCT/US2010/034346, mailed Jul. 15, 2010, 14 pages.

* cited by examiner

*Primary Examiner* — Milton Nelson, Jr.

(74) *Attorney, Agent, or Firm* — Shook Hardy & Bacon LLP

(57) ABSTRACT

Extendable ottoman linkages supporting both a main and secondary ottoman, as well as high-leg, space-saving recliners for which such linkages are designed, are provided. The extendable ottoman linkages provide sufficient clearance for a secondary ottoman to extend by arranging the components of the linkage such that the extension of the secondary ottoman is delayed until the main ottoman has extended sufficiently to provide the necessary clearance. The extendable ottoman linkages further hold the secondary ottoman securely in a closed position when the furniture is in a closed position.

20 Claims, 8 Drawing Sheets

RECLINER OTTOMAN LINKAGE WITH UNIQUE SECONDARY OTTOMAN

CROSS-REFERENCE TO RELATED APPLICATIONS

This application claims priority to U.S. provisional application 61/177,135, filed May 11, 2009, which is hereby incorporated by reference.

STATEMENT REGARDING FEDERALLY SPONSORED RESEARCH OR DEVELOPMENT

Not applicable.

TECHNICAL FIELD

The present invention relates to furniture. More particularly, the present invention is related to reclining chairs having a high-leg, space-saving design.

BACKGROUND

Chair style is an important factor in the commercial success of a chair. One such style of chair is known as a "high-leg" chair. The high-leg chair may be envisioned as removing the lower section of a typical upholstered chair and extending the support legs from the bottom of the chair to the floor. The support legs can then be made into more fashionable designs. Another style of chair is a space-saving recliner in which the chair is often able to fully recline but does not extend backward when reclined as is typical with reclining chairs. This space-saving design allows a fully reclining chair to be placed close to a wall or object behind the chair. One problem encountered when attempting to incorporate a high-leg style into a space-saving recliner design is that any lower portion of the chair removed for the purpose of high leg styling also removes the lower portion of the main ottoman that provides support for a user's feet when the chair is reclined, reducing the user's comfort.

Previous attempts to remedy the reduced support offered by a smaller main ottoman resulting from a high-leg chair design have incorporated a secondary ottoman into the ottoman linkage (also known as the footrest linkage). In these previous attempts, however, the reclining mechanism included in the high-leg chair was a traditional mechanism that moves up and toward the rear of the chair when the chair extends to recline. The movement of the traditional mechanism provides sufficient clearance for a secondary ottoman to extend during reclining.

In contrast to the movement of a traditional mechanism, in a space-saving design, the initial movement of the reclining mechanism is forward and downward. This forward and downward movement does not provide adequate clearance for a secondary ottoman to extend during reclining, making the incorporation of a secondary ottoman to provide additional foot support unworkable in a high-leg chair with a fully reclining, space-saving design.

Another drawback of secondary ottomans incorporated into traditional mechanisms is that the weight of the secondary ottoman often causes the secondary ottoman to pivot open slightly. This in turn causes the main ottoman to pivot open slightly. Because the main ottoman forms the lower front portion of the chair, the end result of the slight pivoting of the secondary ottoman is that the chair appears slightly open when it is supposed to be in the closed and upright position. A common way to prevent this undesirable appearance is to add an extension spring to hold the ottoman closed. The extension spring, however, creates an additional problem, because the occupant of the chair must overcome significant added spring pressure to extend the chair into a reclining position. The addition of an extension spring is also costly, and the spring can be unreliable.

SUMMARY

Embodiments of the present invention relate to extendable ottoman linkages configured for installation in high-leg reclining furniture having a main ottoman and a secondary ottoman. The extendable ottoman linkages provide sufficient clearance for a secondary ottoman to extend by arranging the components of the linkage such that the extension of the secondary ottoman is delayed until the main ottoman has extended sufficiently to provide the necessary clearance. The extendable ottoman linkages further hold the secondary ottoman securely in a closed position when the furniture is in a closed position.

In one embodiment, an extendable ottoman linkage is configured for installation in a piece of high-leg reclining furniture with a space-saving design having extendable main and secondary ottomans. The extendable ottoman linkage comprises a main ottoman link, a secondary ottoman link, a secondary ottoman drive link, and a connector link. The main ottoman link has a first end and a second end and is attached at the second end to the main ottoman. The secondary ottoman link has a first end and a second end and is attached at the first end to the secondary ottoman and pivotally connected at the second end to the first end of the main ottoman link via a secondary ottoman pivot. The secondary ottoman drive link has a first end and a second end and is pivotally connected at the first end to the second end of the main ottoman link via a secondary ottoman connector drive pivot. The connector link has a first end and a second end and is pivotally connected at the first end to the second end of the secondary ottoman link via a secondary ottoman drive pivot and pivotally connected at the second end to the first end of the secondary ottoman drive link via a secondary ottoman connector pivot. The arrangement of the main ottoman link, secondary ottoman link, secondary ottoman drive link, and connector link and the locations of the secondary ottoman pivot, secondary ottoman connector drive pivot, secondary ottoman drive pivot, and secondary ottoman connector pivot is selected to delay extension of the secondary ottoman until the main ottoman is sufficiently extended to provide clearance for the secondary ottoman.

In another embodiment, an extendable ottoman linkage is configured for installation in a piece of high-leg reclining furniture with a space-saving design having extendable main and secondary ottomans. The extendable ottoman linkage comprises a main ottoman link, a secondary ottoman link, a secondary ottoman drive link, and a connector link. The main ottoman link has a first end and a second end and is attached at the second end to the main ottoman. The secondary ottoman link has a first end and a second end and is attached at the first end to the secondary ottoman and pivotally connected at the second end to the first end of the main ottoman link via a secondary ottoman pivot. The secondary ottoman drive link has a first end and a second end and is pivotally connected at the first end to the second end of the main ottoman link via a secondary ottoman connector drive pivot. The connector link has a first end and a second end and is pivotally connected at the first end to the second end of the secondary ottoman link via a secondary ottoman drive pivot and pivotally connected at the second end to the first end of the secondary ottoman drive link via a secondary ottoman connector pivot.

In this embodiment, when the furniture is in a closed position and when the linkage is viewed from a side view such that the extendable ottomans extend to the right, a line drawn between the center of the secondary ottoman connector drive pivot and the secondary ottoman drive pivot forms an acute angle with the main ottoman to the right of the line. From this view, the secondary ottoman connector pivot is located between the secondary ottoman connector drive pivot and the secondary ottoman drive pivot. Also from this view, the secondary ottoman connector pivot is centered slightly to the left of the line drawn between the center of the secondary ottoman connector drive pivot and the center of the secondary ottoman drive pivot.

In still another embodiment, a high-leg, space-saving reclining chair comprises a chair body having four legs and a seat; a recliner mechanism attached to the chair body, wherein when the chair is reclined, the recliner mechanism moves forward and downward; a back portion pivotally connected to the recliner mechanism; an extendable main ottoman and extendable secondary ottoman; and an ottoman linkage pivotally connected to the recliner mechanism and to the extendable main ottoman and extendable secondary ottoman. The ottoman linkage comprises a main ottoman link, a secondary ottoman link, a secondary ottoman drive link, and a connector link. The main ottoman link has a first end and a second end and is attached at the second end to the main ottoman. The secondary ottoman link has a first end and a second end and is attached at the first end to the secondary ottoman and pivotally connected at the second end to the first end of the main ottoman link via a secondary ottoman pivot. The secondary ottoman drive link has a first end and a second end and is pivotally connected at the first end to the second end of the main ottoman link via a secondary ottoman connector drive pivot. The connector link has a first end and a second end and is pivotally connected at the first end to the second end of the secondary ottoman link via a secondary ottoman drive pivot and pivotally connected at the second end to the first end of the secondary ottoman drive link via a secondary ottoman connector pivot.

In this embodiment, when the chair is in a closed position and when the linkage is viewed from a side view such that the extendable ottomans extend to the right, a line drawn between the center of the secondary ottoman connector drive pivot and the secondary ottoman drive pivot forms an acute angle with the main ottoman to the right of the line. From this view, the secondary ottoman connector pivot is between the secondary ottoman connector drive pivot and the secondary ottoman drive pivot. Also from this view, the secondary ottoman connector pivot is centered slightly to the left of the line drawn between the center of the secondary ottoman connector drive pivot and the center of the secondary ottoman drive pivot. Further from this view, the center of the secondary ottoman drive pivot is below and to the right of the center of the secondary ottoman pivot.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE SEVERAL VIEWS OF THE DRAWINGS

Embodiments of the present invention are described in detail below with reference to the attached drawing figures, wherein.

DETAILED DESCRIPTION

Embodiments of the present invention are described with specificity herein to meet statutory requirements. However, the description itself is not intended to limit the scope of this patent. Rather, the inventor has contemplated that the claimed subject matter might also be embodied in other ways.

As discussed above, previous attempts at solving the problems caused by a high-leg recliner design are unworkable when implemented in a space-saving recliner design. In a high-leg design, the ottoman that extends to support the legs and feet in a reclined position is smaller than in a traditional recliner design and does not offer as much support as the traditional design. The secondary ottoman used to provide additional support in a high-leg recliner cannot be implemented in a space-saving recliner because the movement of the reclining mechanism in the space-saving recliner design does not provide sufficient clearance for the secondary ottoman to extend. Additionally, traditional secondary ottomans must be equipped with an extension spring to prevent unintentional slight opening when the ottoman is not extended and the chair is in a "closed" position. Such extension springs are expensive and undesirably increase the amount of force a user must exert to extend the ottoman.

Embodiments of the present invention overcome the problems associated with traditional recliner designs and present novel high-leg, space-saving recliners and corresponding recliner mechanisms and linkages. Traditional recliner design will be further discussed below, followed by a detailed discussion of embodiments of the present invention.

Figure 1A:
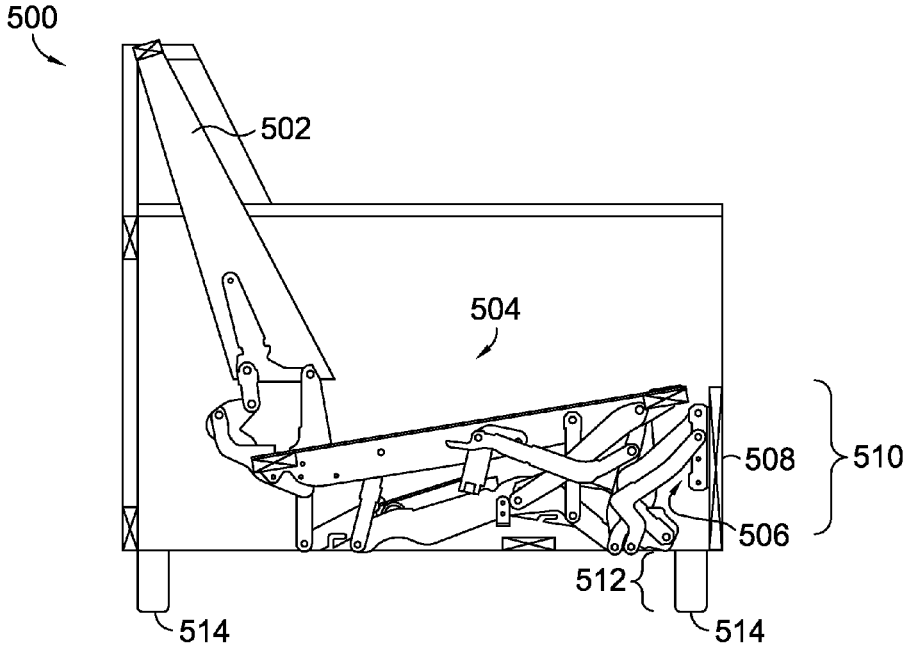
FIG. 1A. PRIOR ART
FIG. 1A is a side elevation view of a prior art high-leg, space-saving reclining chair having a reclining mechanism and an ottoman linkage shown in the closed position.
Figure 1B:
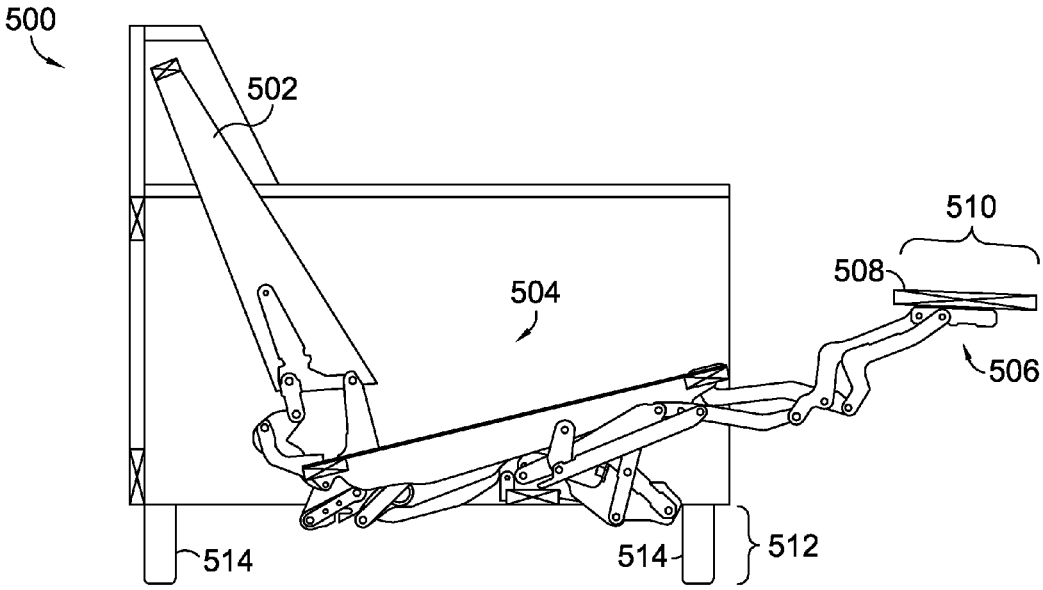
FIG. 1B. PRIOR ART
FIG. 1B is a side elevation view of a prior art high-leg, space-saving reclining chair having a reclining mechanism and an ottoman linkage shown in a reclined position with the ottoman extended.

FIGS. 1A and 1B illustrate prior art high-leg, space-saving recliner 500. Conventional recliners and recliner mechanisms are well known in the art. High-leg recliner 500 comprises back portion 502 connected to recliner mechanism 504. Recliner mechanism 504 is coupled to ottoman linkage 506, which is in turn connected to ottoman 508. High-leg recliner 500 is shown in a "closed" position in FIG. 1, with ottoman 508 secured against high-leg recliner 500. Ottoman 508 has a length 510 that is significantly shortened because of the height 512 of chair legs 514. In a traditional design, the length 510 of ottoman 508 would also include the majority of the height 512 of chair legs 514.

FIG. 1B shows high-leg, space-saving recliner 500 in a reclined position. In the reclined position, back portion 502 is lower and tilted further from vertical than in the closed position depicted in FIG. 1A. Recliner mechanism 504 has also moved downward and forward (away from back portion 502) relative to the closed position. Ottoman 508 is extended outward to provide support for a user's feet and legs via ottoman linkage 506. Length 510 of ottoman 508 is reduced by approximately height 512 of chair legs 514 in comparison to a traditional recliner. The reduced length of ottoman 508 does not provide the desirable amount of support for a user's feet and legs.

Figure 2:
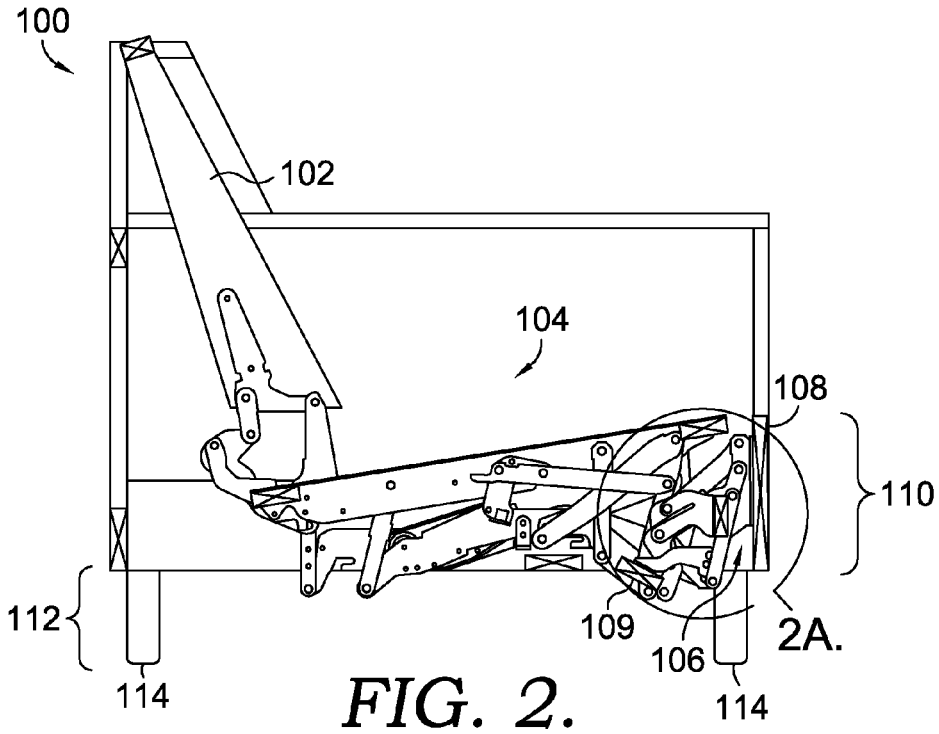
FIG. 2 is a side elevation view of a high-leg, space-saving reclining chair having a reclining mechanism and an ottoman linkage connected to a main and secondary ottoman in accordance with an embodiment of the present invention, the chair shown in the closed position.

Embodiments of the present invention are illustrated in FIGS. 2-9. FIG. 2 illustrates a high-leg, space-saving recliner 100. High-leg, space-saving recliner 100 comprises back portion 102 connected to recliner mechanism 104. Recliner mechanism 104 is pivotally connected to ottoman linkage 106, which is in turn connected to main ottoman 108 and secondary ottoman 109. High-leg, space-saving recliner 100 is shown in a "closed" position in FIGS. 2 and 2A. In some embodiments recliner 100 has a plurality of positions including a closed position in which the main and secondary ottomans are not extended and the back portion and seat are not reclined, a TV viewing position in which the main and secondary ottomans are extended but the back portion and seat are not reclined or are partially reclined, and a fully reclined position in which the main and secondary ottomans are extended and the back portion and seat are fully reclined. In the closed position back portion 102 is not reclined and main ottoman 108 and secondary ottoman 109 are not extended. Main ottoman 108 is secured against recliner 100 in the closed position. Main ottoman 108 has a length 110 that is significantly shortened because of the height 112 of chair legs 114. In a traditional design, the length 110 of main ottoman 108 would also include the majority of the height 112 of chair legs 114.

To supplement the reduced support offered by main ottoman 108, secondary ottoman 109 is included in high-leg, space-saving recliner 100. Extendable ottoman linkage 106 is designed to provide sufficient clearance above the surface on which recliner 100 rests for secondary ottoman 109 to extend outward. The connection of an ottoman linkage with a recliner mechanism, such as ottoman linkage 106 and recliner mechanism 104, are well known to one having ordinary skill in the art and are not discussed in great detail. Extendable ottoman linkage 106 is more clearly illustrated in FIG. 2A.

Figure 2A:
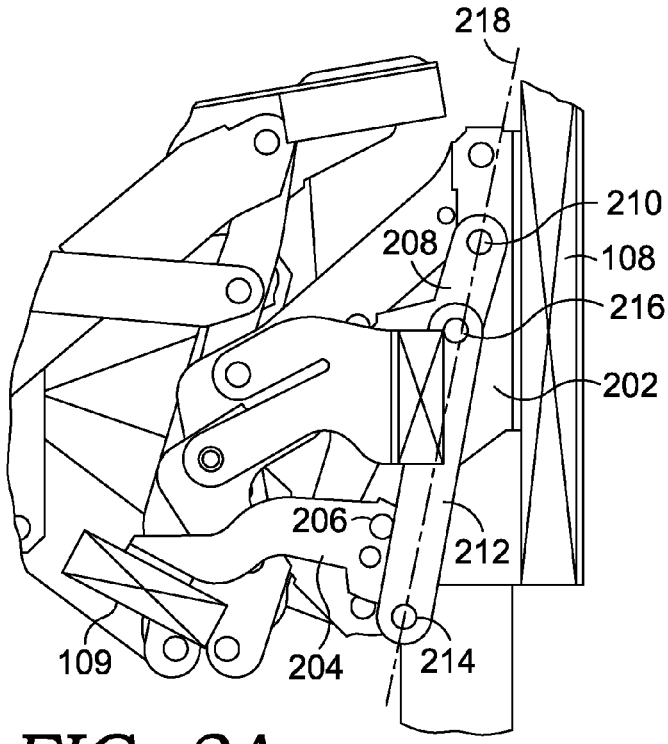
FIG. 2A is an enlarged side elevation view of the encircled region labeled "2A" in FIG. 2.

FIG. 2A shows extendable ottoman linkage 106 and various parts of recliner mechanism 104. Main ottoman link 202 is attached to main ottoman 108. Secondary ottoman link 204 is attached to secondary ottoman 109 and pivotally connected to main ottoman link 202 via secondary ottoman pivot 206. Secondary ottoman drive link 208 is pivotally connected to main ottoman link 202 via secondary ottoman connector drive pivot 210. Connector link 212 is pivotally connected to secondary ottoman link 204 via secondary ottoman drive pivot 214 and is pivotally connected to secondary ottoman drive link 208 via secondary ottoman connector pivot 216.

The arrangement of main ottoman link 202, secondary ottoman link 204, secondary ottoman drive link 208, and connector link 212 and the locations of secondary ottoman pivot 206, secondary ottoman connector drive pivot 210, secondary ottoman drive pivot 214, and secondary ottoman connector pivot 216 are selected to delay extension of secondary ottoman 109 until main ottoman 108 is sufficiently extended to provide clearance for secondary ottoman 109. The cause of the delay in extension can be understood with reference to center line 218 drawn between the center points of secondary ottoman connector drive pivot 210 and secondary ottoman drive pivot 214.

Linkage 106 is designed such that the center point of secondary ottoman connector pivot 216 is slightly to the left of center line 218. In FIG. 2A, secondary ottoman connector pivot 216 intersects center line 18 while the center of secondary ottoman connector pivot 216 is not intersected by center line 18. In order for secondary ottoman 109 to rotate counterclockwise and extend, secondary ottoman 109 must first rotate slightly clockwise, causing connector link 212 to rotate slightly clockwise such that secondary ottoman connector drive pivot 210, secondary ottoman drive pivot 214, and secondary ottoman connector pivot 216 are collinear. Thus, as main ottoman 108 extends outward and secondary ottoman 109 moves as a result of that extension, counterclockwise movement of secondary ottoman 109 is delayed because secondary ottoman 109 must first rotate slightly clockwise. By the time secondary ottoman 109 has rotated the necessary amount clockwise, main ottoman 108 has rotated and extended enough to provide sufficient clearance for secondary ottoman 109 to begin counterclockwise rotation and extension.

A further advantage of extendable ottoman linkage 106 as shown in FIG. 2A is that the arrangement of links and pivots holds secondary ottoman 109 and primary ottoman 108 securely in a closed position when recliner 100 is in a closed position. As discussed above, in traditional designs featuring secondary ottomans, the weight of the secondary ottoman causes a slight extension of the secondary and main ottomans, causing the recliner to appear slightly open when it is meant to be in a closed position. Previous solutions to this problem involve using a spring to hold the secondary ottoman in place. This, however, requires a user to provide a significantly greater force to release the ottomans and extend the ottoman linkage.

In contrast, the arrangement of links and pivots shown in FIG. 2A secures secondary ottoman 109 and primary ottoman 108 without requiring the application of additional user force. As described above, the center point of secondary ottoman connector pivot 216 is slightly to the left of center line 218 drawn between the center points of secondary ottoman connector drive pivot 210 and secondary ottoman drive pivot 214. The downward force of gravity on secondary ottoman 109

(weight) causes secondary ottoman link 204 to want to rotate counterclockwise, exerting a force upward and to the right on connector link 212 via secondary ottoman drive pivot 214, which in turn exerts a force upward and to the right on main ottoman link 202 and main ottoman 108. This force exerted on main ottoman 108 prevents main ottoman 108 from opening in the absence of an additional applied force, thereby securing both main ottoman 108 and secondary ottoman 109 in a closed position when reclining chair 100 is in the closed position.

Figure 3:
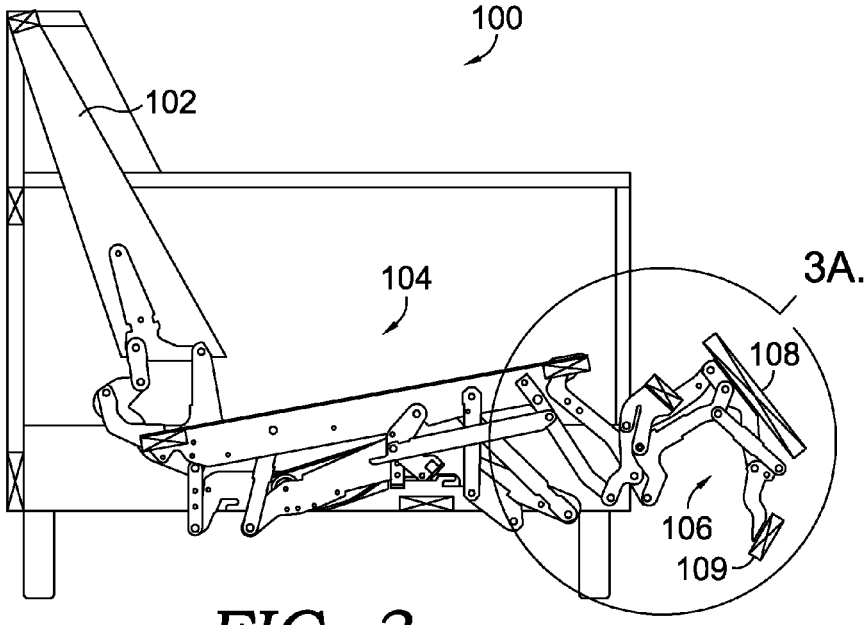
FIG. 3 is a side elevation view of the high-leg, space-saving reclining chair illustrated in FIG. 2 showing the chair in a partially reclined position with the main and secondary ottomans partially extended in accordance with an embodiment of the present invention.
Figure 3A:
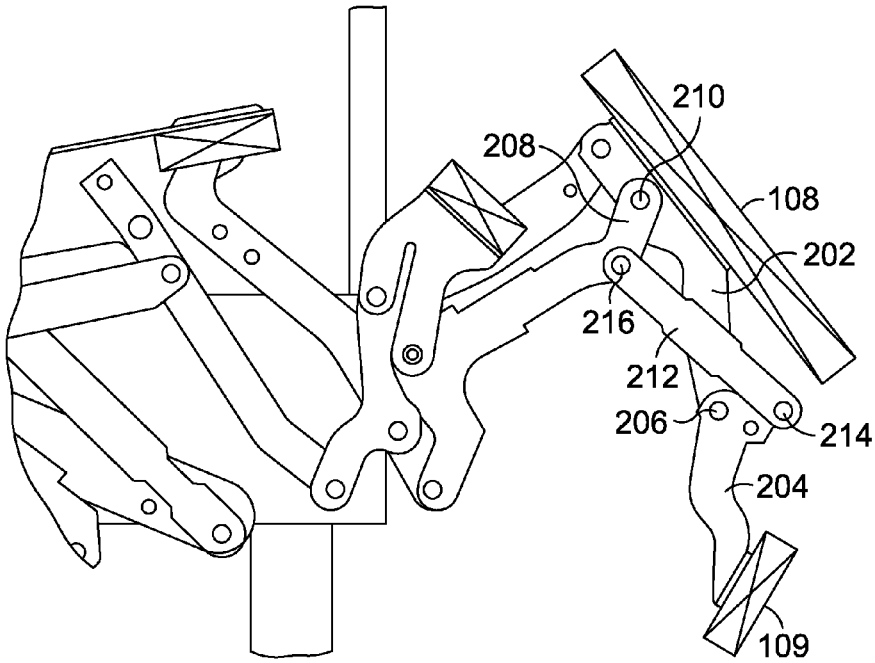
FIG. 3A is an enlarged side elevation view of the encircled region labeled "3A" in FIG. 3.

The movement of main ottoman 108 and secondary ottoman 109 from a closed position to an extended position when chair 100 is reclined is illustrated in FIGS. 3, 3A, 4, and 4A. FIG. 3 shows high-leg, space-saving recliner 100 in a partially reclined, partially extended position. The reclining motion of recliner mechanism 104 has moved back portion 102 slightly back and down, and mechanism 104 has compressed slightly. Expandable ottoman linkage 106 is shown supporting main ottoman 108 and secondary ottoman 109 as they rotate counterclockwise and extend outward from the body of recliner 100. Ottoman linkage 106, including the links and pivots discussed above, as well as main ottoman 108 and secondary ottoman 109, along with various parts of recliner mechanism 104 are shown more clearly in FIG. 3A.

Figure 4:
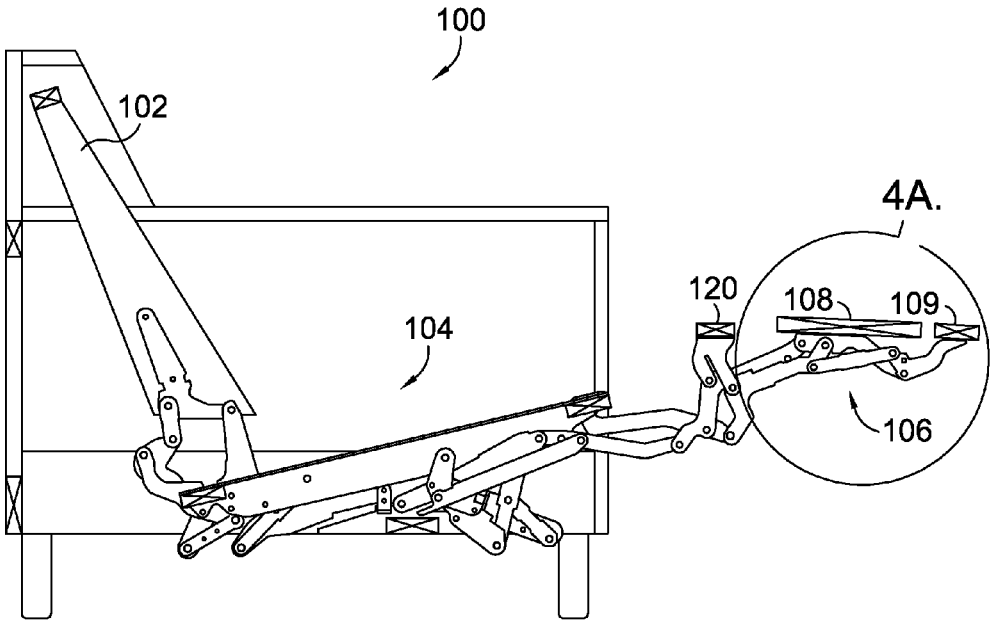
FIG. 4 is a side elevation view of the high-leg, space-saving reclining chair illustrated in FIGS. 2 and 3 showing the chair in a reclined position with the main and secondary ottomans fully extended in accordance with an embodiment of the present invention.
Figure 4A:
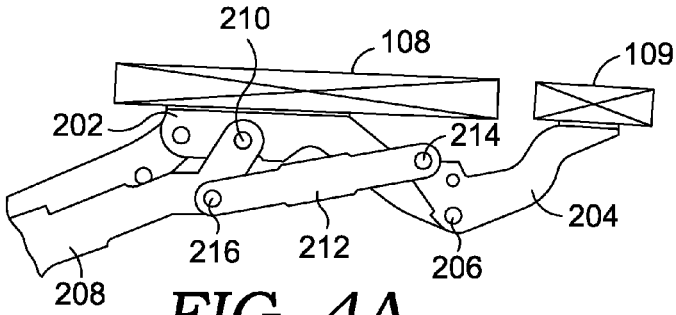
FIG. 4A is an enlarged side elevation view of the encircled region labeled "4A" in FIG. 4.

Secondary ottoman link 204 and attached secondary ottoman 109 are rotated to a partially extended position by the action of the secondary ottoman drive link 208 through connector link 212. Further rotation caused by secondary ottoman drive link 208 moves secondary ottoman 109 into a fully extended position as shown in FIG. 4. FIG. 4 shows high-leg, space-saving recliner 100 in a reclined position with main ottoman 108 and secondary ottoman 109 fully extended. Back portion 102 is reclined and lower than in the closed or partially reclined positions. Mechanism 104 has collapsed further and is now lower and farther to the right than in FIGS. 2 and 3. Main ottoman 108 and secondary ottoman 109 are substantially horizontal to provide support for a user's feet and legs. Also shown in FIG. 4 is mid ottoman 120. Mid ottoman 120 provides further support for a user's legs between main ottoman 108 and the body of recliner 100. FIG. 4A illustrates the links and pivots of ottoman linkage 106 when main ottoman 108 and secondary ottoman 109 are in a fully extended position.

Figure 5:
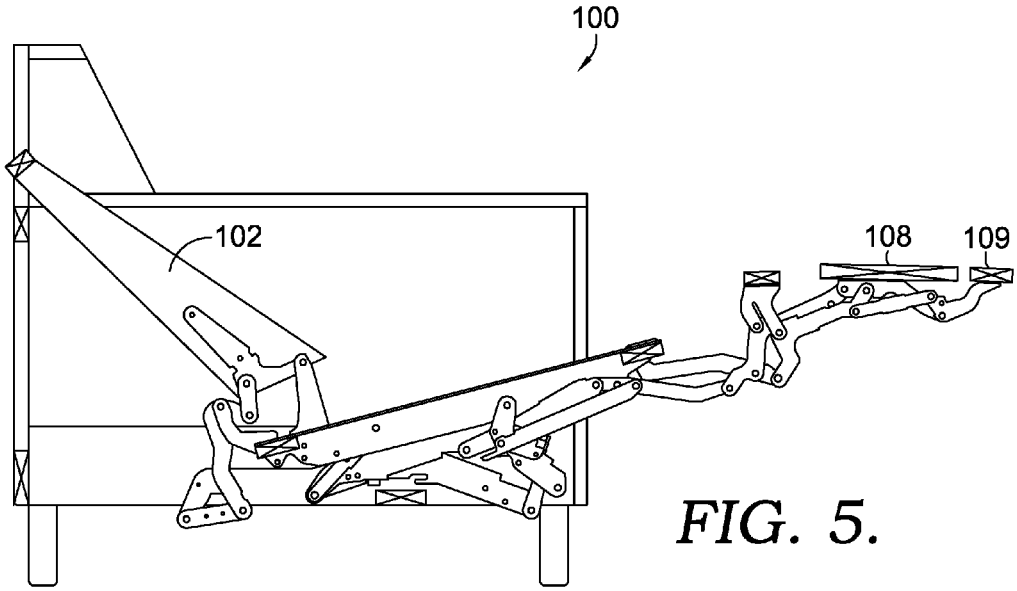
FIG. 5 is a side elevation view of the high-leg, space-saving reclining chair illustrated in FIGS. 2-4 showing the chair in a fully reclined position with the main and secondary ottomans fully extended in accordance with an embodiment of the present invention.

FIG. 5 illustrates high-leg, space-saving recliner 100 in a fully reclined position with main ottoman 108 and secondary ottoman 109 fully extended. Back portion 102 is still more reclined than the position illustrated in FIG. 4.

Figure 6:
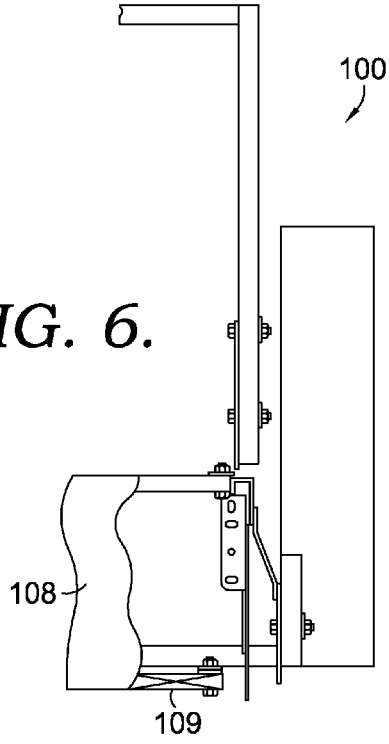
FIG. 6 is a partial, front elevation view of the high-leg, space-saving chair and ottoman linkage illustrated in FIGS. 2-5 in accordance with an embodiment of the present invention showing the attachment of the linkage to the chair.

FIG. 6 is a partial front elevation view of high-leg, space-saving recliner 100 and ottoman linkage 106 illustrated in FIGS. 2-5. FIG. 6 shows the attachment of linkage 106 to recliner 100 when recliner 100 is in the closed position. Secondary ottoman 109 is visible substantially horizontal. Main ottoman 108 is partially cutaway to reveal the attachment of linkage 106 to recliner 100.

Figure 7:
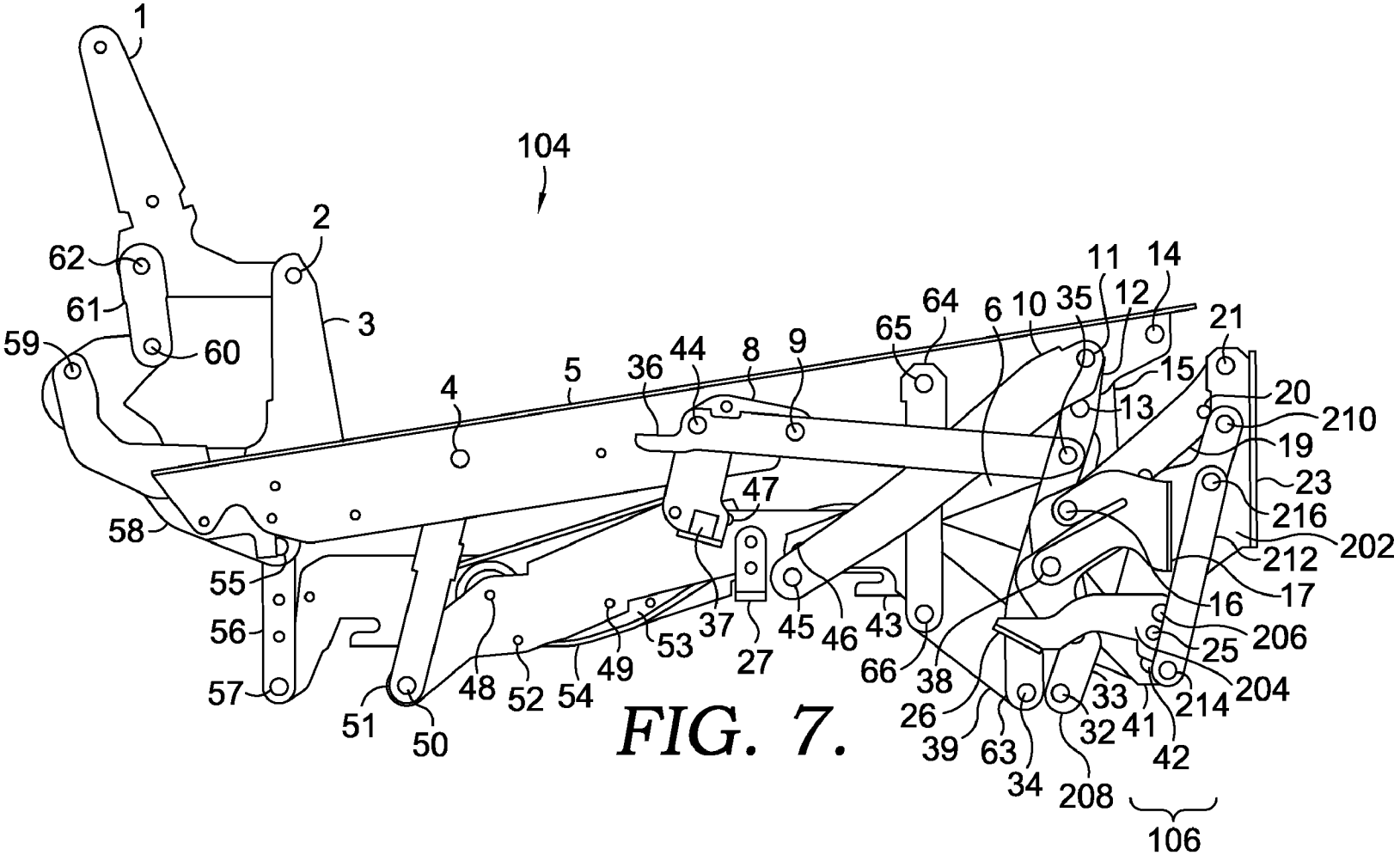
FIG. 7 is a detailed side elevation view of the recliner mechanism and ottoman linkage in accordance with an embodiment of the present invention in the closed position.
Figure 8:
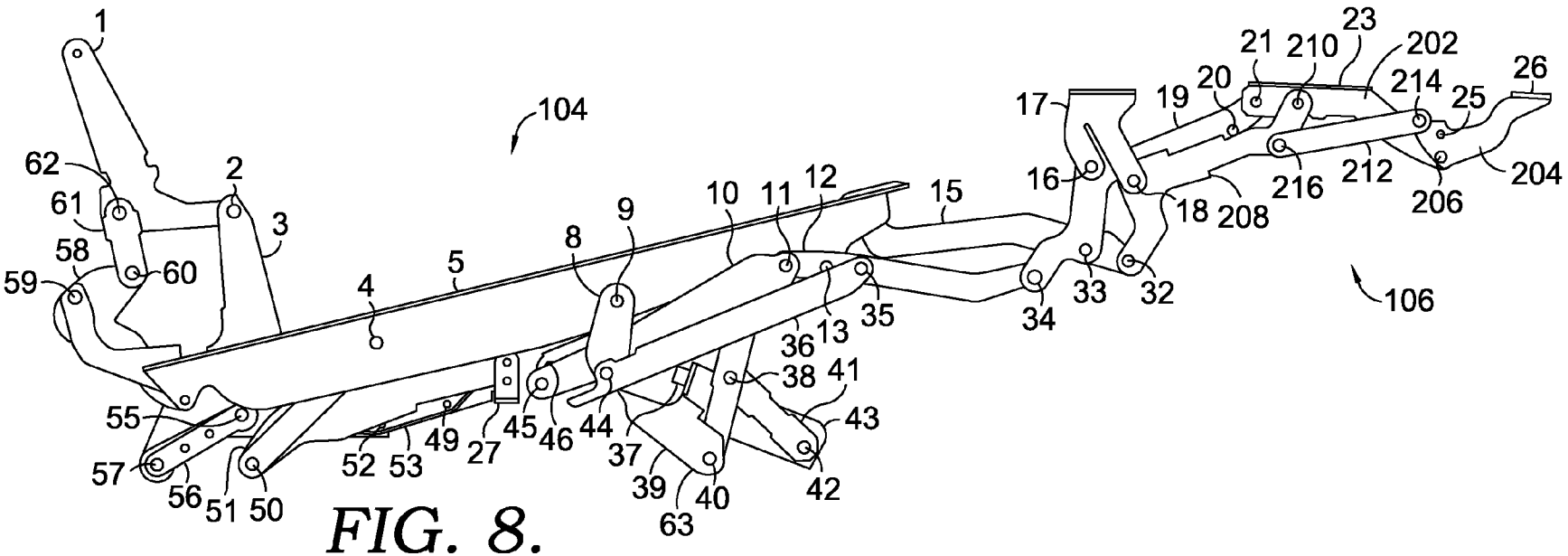
FIG. 8 is a detailed side elevation view of the recliner mechanism and ottoman linkage in accordance with an embodiment of the present invention in a reclined position with the ottoman linkage extended.
Figure 9:
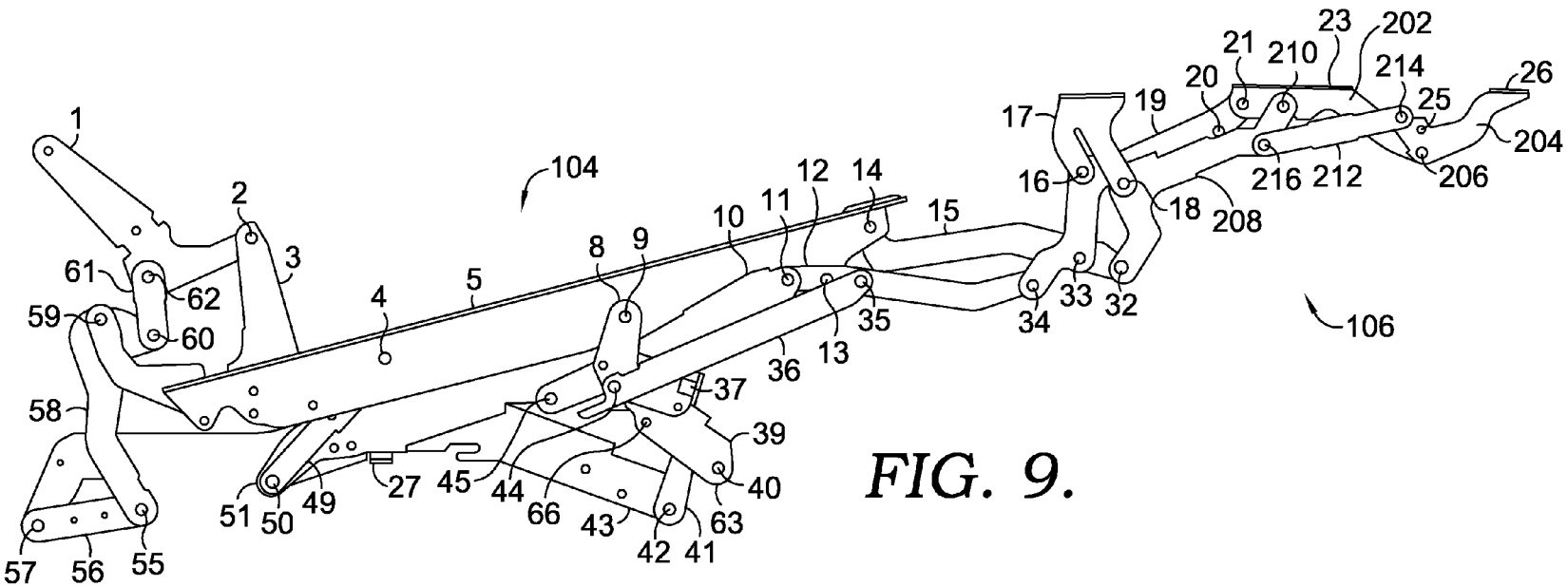
FIG. 9 is a detailed side elevation view of the recliner mechanism and ottoman linkage in accordance with an embodiment of the present invention in a fully reclined position with the ottoman linkage extended.

FIG. 7 shows recliner mechanism 104 and extendable ottoman linkage 106 in the closed position. FIG. 8 illustrates a reclined position in which the back is reclined and seat lowered and the main and secondary ottomans are extended. FIG. 9 illustrates a fully reclined position in which the back is fully reclined, seat is lowered, and main and secondary ottomans are extended. In implementing a secondary ottoman as described herein, the attachment points for attaching recliner mechanism 104 to the frame of recliner 100 are moved up compared to a traditional space-saving recliner to avoid chair frame interference. The following describes the attachment of recliner mechanism 104 to the chair frame as well as the interaction of recliner mechanism 104 and linkage 106.

Referring now to FIGS. 7-9, chair arms are attached to mechanism 104 by base plate 43. A seat is attached to seat angle 5, the seat moveable from a closed position to a reclined TV viewing position with the main ottoman and secondary ottoman extended and further moveable into a fully reclined position. Mechanism 104 accommodates a pivoting back at back link 1. The back is moveable as one unit with the seat into the TV viewing position and further back into a fully reclined position. Mechanism 104 accommodates a mid ottoman attached at mid ottoman bracket 17, a main ottoman attached at main ottoman bracket 23, and a secondary ottoman attached at secondary ottoman bracket 26. As discussed in detail above, these ottomans are moveable from a closed position to an extended position and moved as a unit with the seat into a fully reclined position.

The force of the chair occupant's weight is responsible for movement of the seat angle 5 and back plate 1 into the TV viewing position and is a result of rear TV pivot link 51 and front TV pivot link 64 pivoting around points 50 and 66 on roller link 39 and pivoting around points 4 and 65 where attached to seat angle 5. The downward and forward movement of the seat and back relative to the arms is responsible for moving the ottomans into their extended position as drive link 10 (attached at the rear point 45 to roller link 39 and to third ottoman link 12 at forward point 11) causes third ottoman link 12 to rotate counterclockwise at point 13, where it is affixed to seat angle 5. Rotation of third ottoman link 12 causes the upward and forward movement of first ottoman link 19 through pivot 34, while the positioning of first ottoman link 19 is controlled by fourth ottoman link 15 where it is attached at point 33 and conversely attached to seat angle 5 at point 15.

First ottoman link 19 is responsible for extending the mid ottoman attached to mid ottoman bracket 17 where attached at point 16 and the main ottoman attached to main ottoman bracket 23 where attached at point 21. The amount of extended movement is determined by placement of a stop 20 in the first ottoman link 19, the contact of stop 20 with second ottoman drive link 208 restricting further rotation. The main ottoman is held in the closed position by lock link 8 attached to seat angle 5 at pivot point 9 and long lock link 36 that is attached at the rear to lock link 8 at pivot point 4 and forwardly attached to third ottoman link 12 at point 35. Lock link 8 and long lock link 36 are so configured to allow pivot point 9 to move into an over-center position between connecting points 44 and 35 when in the closed position, thus holding the main ottoman closed until downward pressure is applied to long lock link 36.

This movement is transferred and controlled to the opposing side mechanism through a square tube rigidly fastened to lock link 8 through square hole 37. The position of the secondary ottoman is held in the closed position as described in detail above with regard to FIG. 2A by the over-center positioning of secondary ottoman connector pivot 216 in relation to a line connecting the centers of secondary ottoman connector drive pivot 210 and secondary ottoman drive pivot 214 and is controlled by stop 25 in the secondary ottoman and stop 25's contact with connector link 212 in the closed position as shown in FIG. 7. The forward movement of the ottomans and linkage previously described remains constant as the mechanism moves into the fully reclined position illustrated in FIG. 9. This fully reclined position involves the forward and upward movement of the back, seat, and ottomans and is a result of pressure applied to the back of the chair transferred to mechanism 104 through back link 1, resulting in clockwise rotation around back mounting plate 3 that is rigidly attached to seat angle 5. The rotation of back link 1 causes the downward movement of short back pivot link 61 through pivot points 62 and 60. This downward movement causes the clockwise rotation of bell crank 58 around its attachment point to back mounting plate 3 at pivot point 59. The clockwise rotation of bell crank 58 causes the relative rearward movement of the base plate 43 through the rear control link 56 and its pivotal connection to the bell crank 58 at pivot point 55 and to the base plate 43 at pivot point 57.

This forward and upward movement and positioning of the back, seat, and ottoman is controlled at the rear by a track and roller assembly shown in the TV viewing position in FIG. 8 and the fully reclined position shown in FIG. 9. The track is comprised of two parts, lower track 53 and track 54, both of which are rigidly affixed to base plate 43 at points 49 and 52. The track assembly encases and supports a roller 48 that is attached to roller link 39 and is positioned at the rear of track 54 in the TV viewing position as shown in FIG. 8 and moves up track 54 to the fully reclined position illustrated in FIG. 9

The movement of roller 48 is determined by a stop 47 placed in track 54 contacting roller 48. The positioning of the front of the seat and ottomans in the fully reclined position is controlled by a link arm arrangement comprised of front connector link 6 attached at the rear to base plate 43 at pivot point 46 and forwardly to upper travel link 63 at pivot point 7. During the fully reclined movement, upper travel link 63 rotates clockwise around pivot point 7 driven by its attachment at the lower end to roller link 39. The support of this linkage and the upper positioning is determined by lower travel link 41 and lower travel link 41's attachment to upper travel link 63 at pivot point 38 and the attachment to base plate 43 at point 42.

In summary, the downward and forward movement of the chair back and seat to the TV viewing position, in conjunction with the weight of the occupant, forces the main and secondary ottomans to extend. The force applied to the back of the chair counterbalances the force applied to the ottomans when legs are rested on the ottomans.

Embodiments of the invention are described herein with reference to high-leg, space-saving reclining chairs. As is understood by one having ordinary skill in the art, the extendable linkages supporting secondary ottomans as described herein may be incorporated in other high-leg, space-saving reclining furniture such as loveseats, couches, and sectionals.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

The invention claimed is:

1. An extendable ottoman linkage that provides extendable main and secondary ottomans and that is configured for installation in a piece of high-leg reclining furniture, the extendable ottoman linkage comprising:

a main ottoman link having a first end and a second end, the main ottoman link attached at the second end to the main ottoman;

a secondary ottoman link having a first end and a second end, the secondary ottoman link attached at the first end to the secondary ottoman and pivotally connected at the second end to the first end of the main ottoman link via a secondary ottoman pivot;

a secondary ottoman drive link having a first end and a second end, the secondary ottoman drive link pivotally connected at the first end to the second end of the main ottoman link via a secondary ottoman connector drive pivot; and a connector link having a first end and a second end, the connector link pivotally connected at the first end to the second end of the secondary ottoman link via a secondary ottoman drive pivot and pivotally connected at the second end to the first end of the secondary ottoman drive link via a secondary ottoman connector pivot, wherein the arrangement of the main ottoman link, secondary ottoman link, secondary ottoman drive link, and connector link and the locations of the secondary ottoman pivot, secondary ottoman connector drive pivot, secondary ottoman drive pivot, and secondary ottoman connector pivot is selected to delay extension of the secondary ottoman until the main ottoman is sufficiently extended to provide clearance for the secondary ottoman.

2. The linkage of claim 1, wherein the linkage holds the secondary ottoman securely in a closed position when the main ottoman is not extended.

3. The linkage of claim 1, wherein the linkage attaches to a reclining mechanism in the high-leg reclining furniture.

4. The linkage of claim 1, further comprising a mid ottoman attached to the secondary ottoman drive link, wherein the main ottoman is positioned between the mid ottoman and the secondary ottoman when the main ottoman is extended.

5. The linkage of claim 1, wherein the piece of high-leg reclining furniture is a chair having a back portion and seat.

6. The linkage of claim 5, wherein the chair has a plurality of seating positions including a closed position in which the main and secondary ottomans are not extended and the back portion and seat are not reclined, a TV viewing position in which the main and secondary ottomans are extended but the back portion and seat are not reclined or are partially reclined, and a fully reclined position in which the main and secondary ottomans are extended and the back portion and seat are fully reclined.

7. An extendable ottoman linkage that provides extendable primary and secondary ottomans and that is configured for installation in a piece of high-leg reclining furniture, the extendable ottoman linkage comprising:

a primary ottoman link having a first end and a second end, the primary ottoman link attached at the second end to the primary ottoman;

a secondary ottoman link having a first end and a second end, the secondary ottoman link attached at the first end to the secondary ottoman and pivotally connected at the second end to the first end of the primary ottoman link via a secondary ottoman pivot;

a secondary ottoman drive link having a first end and a second end, the secondary ottoman drive link pivotally connected at the first end to the second end of the primary ottoman link via a secondary ottoman connector drive pivot; and a connector link having a first end and a second end, the connector link pivotally connected at the first end to the second end of the secondary ottoman link via a secondary ottoman drive pivot and pivotally connected at the second end to the first end of the secondary ottoman drive link via a secondary ottoman connector pivot, wherein the linkage is movable between an extended position and a closed position and, when the linkage is in a closed position and is viewed from a side view such that the extendable ottomans extend to the right:

a line drawn between the center of the secondary ottoman connector drive pivot and the secondary ottoman drive pivot forms an acute angle with the primary ottoman to the right of the line, the secondary ottoman connector pivot is between the secondary ottoman connector drive pivot and the secondary ottoman drive pivot, and the secondary ottoman connector pivot is centered slightly to the left of the line drawn between the center of the secondary ottoman connector drive pivot and the center of the secondary ottoman drive pivot.

8. The linkage of claim 7, wherein when the linkage is in the closed position with the linkage viewed from a side view such that the extendable ottomans extend to the right, the secondary ottoman connector pivot intersects the line drawn between the center of the secondary ottoman connector drive pivot and the secondary ottoman drive pivot while the center of the secondary ottoman connector does not intersect the line.

9. The linkage of claim 7, wherein when the linkage is in the closed position with the linkage viewed from a side view such that the extendable ottomans extend to the right, the connector link must rotate clockwise, via the secondary ottoman connector pivot, until the centers of the secondary ottoman connector pivot, secondary ottoman connector drive pivot, and secondary ottoman drive pivot are collinear before the secondary ottoman can begin to extend outward by rotating counterclockwise, causing the linkage to delay extension of the secondary ottoman until the primary ottoman is sufficiently extended to provide clearance for the secondary ottoman.

10. The linkage of claim 7, wherein when the linkage is in a closed position and when the linkage is viewed from a side view such that the extendable ottomans extend to the right, the center of the secondary ottoman drive pivot is below and to the right of the center of the secondary ottoman pivot.

11. The linkage of claim 10, wherein when the linkage is in the closed position and when the linkage is viewed from a side view such that the extendable ottomans extend to the right, the downward force of gravity on the secondary ottoman exerts a force upward and to the right on the connector link via the secondary ottoman drive pivot which in turn exerts a force upward and to the right on the secondary ottoman drive link which exerts a force upward and to the right on the primary ottoman link and primary ottoman, thereby securing the primary and secondary ottomans in a closed position when the linkage is in the closed position.

12. The linkage of claim 7, wherein the linkage attaches to a reclining mechanism in the high-leg reclining furniture.

13. The linkage of claim 7, further comprising a mid ottoman attached to the secondary ottoman drive link, wherein the primary ottoman is positioned between the mid ottoman and the secondary ottoman when the linkage is extended.

14. The linkage of claim 7, wherein the piece of high-leg reclining furniture is a chair having a back portion and a seat.

15. The linkage of claim 14, wherein the chair has a plurality of seating positions including a closed position in which the primary and secondary ottomans are not extended and the back portion and seat are not reclined, a TV viewing position in which the primary and secondary ottomans are extended but the back portion and seat are not reclined or are partially reclined, and a fully reclined position in which the primary and secondary ottomans are extended and the back portion and seat are fully reclined.

16. A high-leg, space-saving reclining chair comprising:

a chair body having four legs and a seat;

a recliner mechanism attached to the chair body, wherein when the chair is reclined, the recliner mechanism moves forward and downward;

a back portion pivotally connected to the recliner mechanism;

an extendable main ottoman and extendable secondary ottoman; and an ottoman linkage pivotally connected to the recliner mechanism and to the extendable main ottoman and extendable secondary ottoman, the ottoman linkage comprising:

a main ottoman link having a first end and a second end, the main ottoman link attached at the second end to the main ottoman;

a secondary ottoman link having a first end and a second end, the secondary ottoman link attached at the first end to the main ottoman and pivotally connected at the second end to the first end of the primary ottoman link via a secondary ottoman pivot;

a secondary ottoman drive link having a first end and a second end, the secondary ottoman drive link pivotally connected at the first end to the second end of the main ottoman link via a secondary ottoman connector drive pivot; and a connector link having a first end and a second end, the connector link pivotally connected at the first end to the second end of the secondary ottoman link via a secondary ottoman drive pivot and pivotally connected at the second end to the first end of the secondary ottoman drive link via a secondary ottoman connector pivot, wherein when the chair is in a closed position and when the linkage is viewed from a side view such that the extendable ottomans extend to the right:

a line drawn between the center of the secondary ottoman connector drive pivot and the secondary ottoman drive pivot forms an acute angle with the main ottoman to the right of the line, the secondary ottoman connector pivot is between the secondary ottoman connector drive pivot and the secondary ottoman drive pivot, the secondary ottoman connector pivot is centered slightly to the left of the line drawn between the center of the secondary ottoman connector drive pivot and the center of the secondary ottoman drive pivot, and the center of the secondary ottoman drive pivot is below and to the right of the center of the secondary ottoman pivot.

17. The high-leg, space-saving reclining chair of claim 16, wherein, when the chair is in the closed position with the linkage is viewed from a side view such that the extendable ottomans extend to the right, the connector link must rotate clockwise, via the secondary ottoman connector pivot, until the centers of the secondary ottoman connector pivot, secondary ottoman connector drive pivot, and secondary ottoman drive pivot are collinear before the secondary ottoman can begin to extend outward by rotating counterclockwise, causing the linkage to delay extension of the secondary ottoman until the main ottoman is sufficiently extended to provide clearance for the secondary ottoman.

18. The high-leg, space-saving reclining chair of claim 16, wherein when the chair is in the closed position with the linkage is viewed from a side view such that the extendable ottomans extend to the right, the downward force of gravity on the secondary ottoman exerts a force upward and to the right on the connector link via the secondary ottoman drive pivot which in turn exerts a force upward and to the right on the secondary ottoman drive link which exerts a force upward and to the right on the main ottoman link and main ottoman, thereby securing the main and secondary ottomans in a closed position when the furniture is in the closed position.

19. The high-leg, space-saving reclining chair of claim 16, wherein the chair has a plurality of seating positions including a closed position in which the main and secondary ottomans are not extended and the back portion and seat are not reclined, a TV viewing position in which the main and secondary ottomans are extended but the back portion and seat are not reclined or are partially reclined, and a fully reclined position in which the main and secondary ottomans are extended and the back portion and seat are fully reclined.

20. The high-leg, space-saving reclining chair of claim 16, further comprising a mid ottoman located between the chair body and main ottoman when the main ottoman is extended.

* * * * *